US006247982B1

(12) United States Patent
Walker

(10) Patent No.: US 6,247,982 B1
(45) Date of Patent: Jun. 19, 2001

(54) SWIM FIN

(76) Inventor: Luther Walker, P.O. Box 5098, Santa Rosa, CA (US) 95402

( * ) Notice: Subject to any disclaimer, the term of this patent is extended or adjusted under 35 U.S.C. 154(b) by 0 days.

(21) Appl. No.: 09/525,665

(22) Filed: Mar. 15, 2000

(51) Int. Cl.[7] ..... A63B 31/08
(52) U.S. Cl. ..... 441/64
(58) Field of Search ..... 441/61–64; D21/806

(56) References Cited

U.S. PATENT DOCUMENTS 3,315,286 * 4/1967 Brion ..... 441/64

* cited by examiner

*Primary Examiner*—Ed Swinehart

(57) ABSTRACT

Swim Fin with a flexible shoe portion, a pair of rotatable hinge members located on opposite sides of the shoe portion, a snap in receptacle located at the end of each the hinge portion, a rigid flat plate located at the sole of the shoe portion, extending beyond the shoe portion by approximately one inch, a pair of vertically oriented brackets each having outwardly protruding, horizontally placed tabs, a strap extending from one the tab to the other said tab, a rigid inverted U shaped member enclosing the forward most portion of said shoe portion, said rigid U shaped member having a slot in each of the side walls and one centrally located slot in the central wall to accept said strap, and a fin having a flat flipper portion and a pair of integral arms extending from said flipper portion that terminate in a male snap that communicates with said female snap located in said shoe portion. A preferred embodiment includes wherein said fin portion can be easily removed and replaced with shorter or longer fin portions.

4 Claims, 5 Drawing Sheets

SWIM FIN

BACKGROUND OF THE INVENTION

This invention relates generally to the field of swimming aids, and more particularly to a swim Fin.

Swim fins have been in use for many years as a swimming aid in helping swimmers travel faster while in the water. Typically a swim fin is an integral unit comprised of a shoe portion and fin portion. Some swim fins employ a full flexible shoe where the user steps into the unit. Other swim fins employ an open backed shoe and a tightening strap that holds the heal into the shoe. For purposes of this discussion and subsequent discussions, I will be referring to the full shoe design, however the present invention relates equally to the open backed strap type shoe.

Swim fins come in various lengths depending on the type of swimming to be done.

Deep ocean swimming may require long fins whereas fresh water or pool swimming may require shorter fins.

Current swim fins have a fin that is integrally connected to the shoe portion so that when a user is trying to walk on a hard surface such as a boat, ladder or beach, he or she must walk awkwardly because of the forwardly extending fins. This can result in the user falling or twisting an ankle. Additionally, a person may need to purchase a plurality of expensive swim fins because of the different swimming conditions he or she may encounter.

SUMMARY OF THE INVENTION

The primary object of the invention is to provide a swim fin where the user can release the fin portion and rotate it up to facilitate walking on land or other firm surfaces.

Another object of the invention is to provide a swim fin where the fin portion can be easily removed and replaced onto the shoe portion thereby allowing for replacement of a deffective fin or replacement of a longer or shorter fin.

Another object of the invention is to provide a swim fin where the fin portion automatically pops up when the release ring is pulled.

A further object of the invention is to provide a swim fin that is stream lined so that seaweed or the like can not get caught on the fin.

Other objects and advantages of the present invention will become apparent from the following descriptions, taken in connection with the accompanying drawings, wherein, by way of illustration and example, an embodiment of the present invention is disclosed.

Swim Fin comprising: a flexible shoe portion, a pair of rotatable hinge members located on opposite sides of said shoe portion, a snap in receptacle located at the end of each said hinge portion, a rigid flat plate located at the sole of said shoe portion, extending beyond the shoe portion by approximately one inch, a pair of vertically oriented brackets each having outwardly protruding, horizontally placed tabs, a strap extending from one said tab to the other said tab, a rigid inverted U shaped member enclosing the forward most portion of said shoe portion, said rigid U shaped member having a slot in each of the side walls and one centrally located slot in the central wall to accept said strap, and a fin having a flat flipper portion and a pair of integral arms extending from said flipper portion that terminate in a male snap that communicates with said female snap located in said shoe portion.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
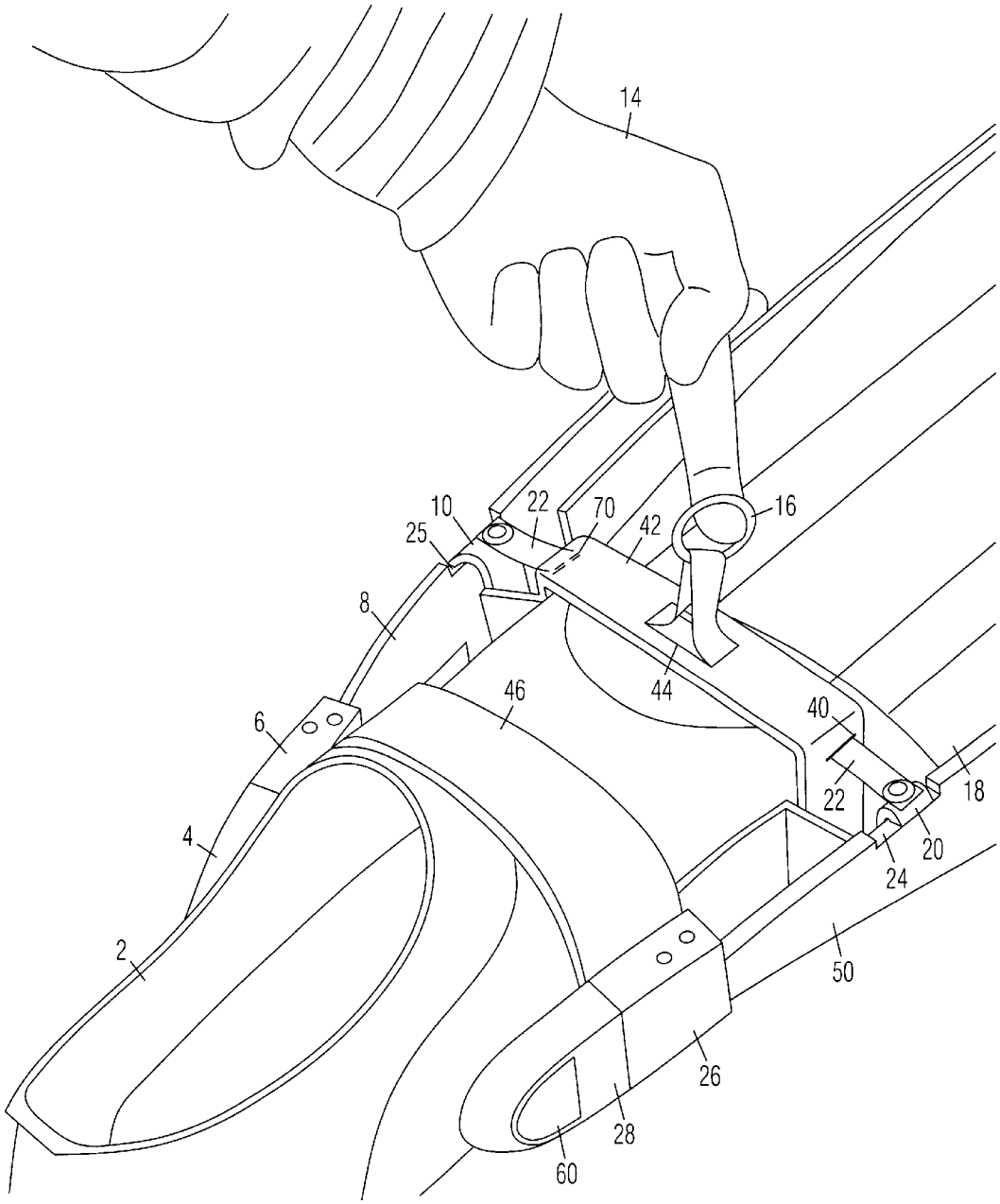
FIG. 1 is a perspective view of the swim fin of the present invention
Figure 2:
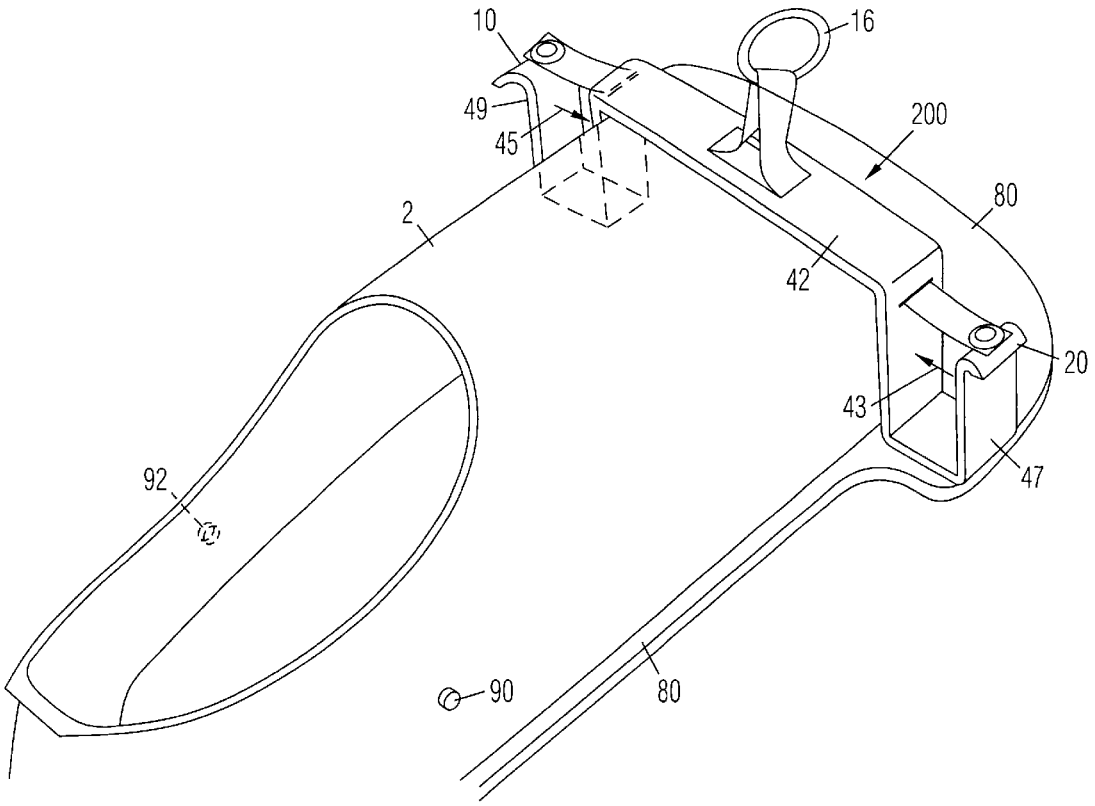
FIG. 2 is a perspective view of the release mechanism of the swim fin of the present invention.
Figure 3:
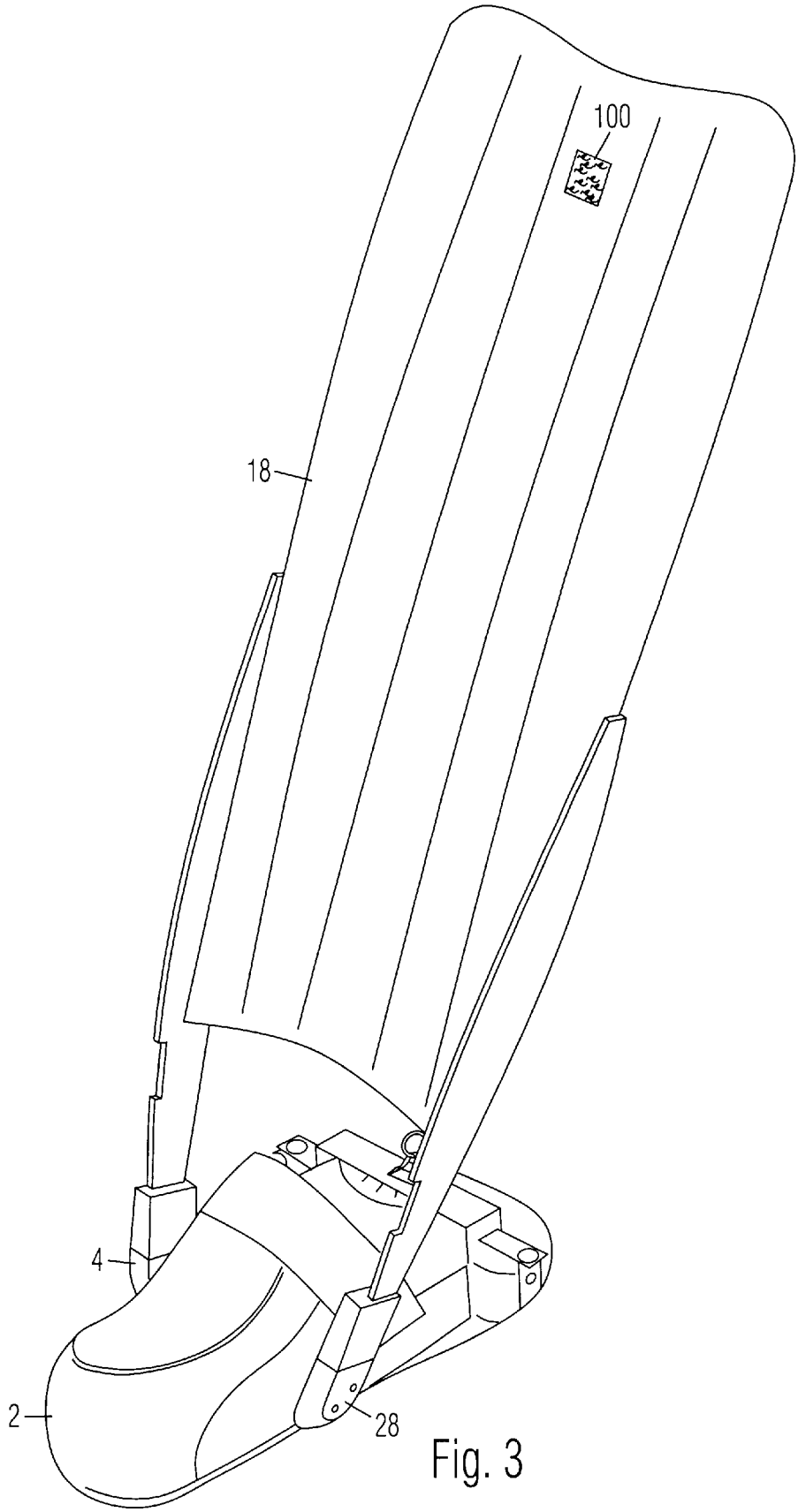
FIG. 3 is a perspective view of the fin in the raised position
Figure 4:
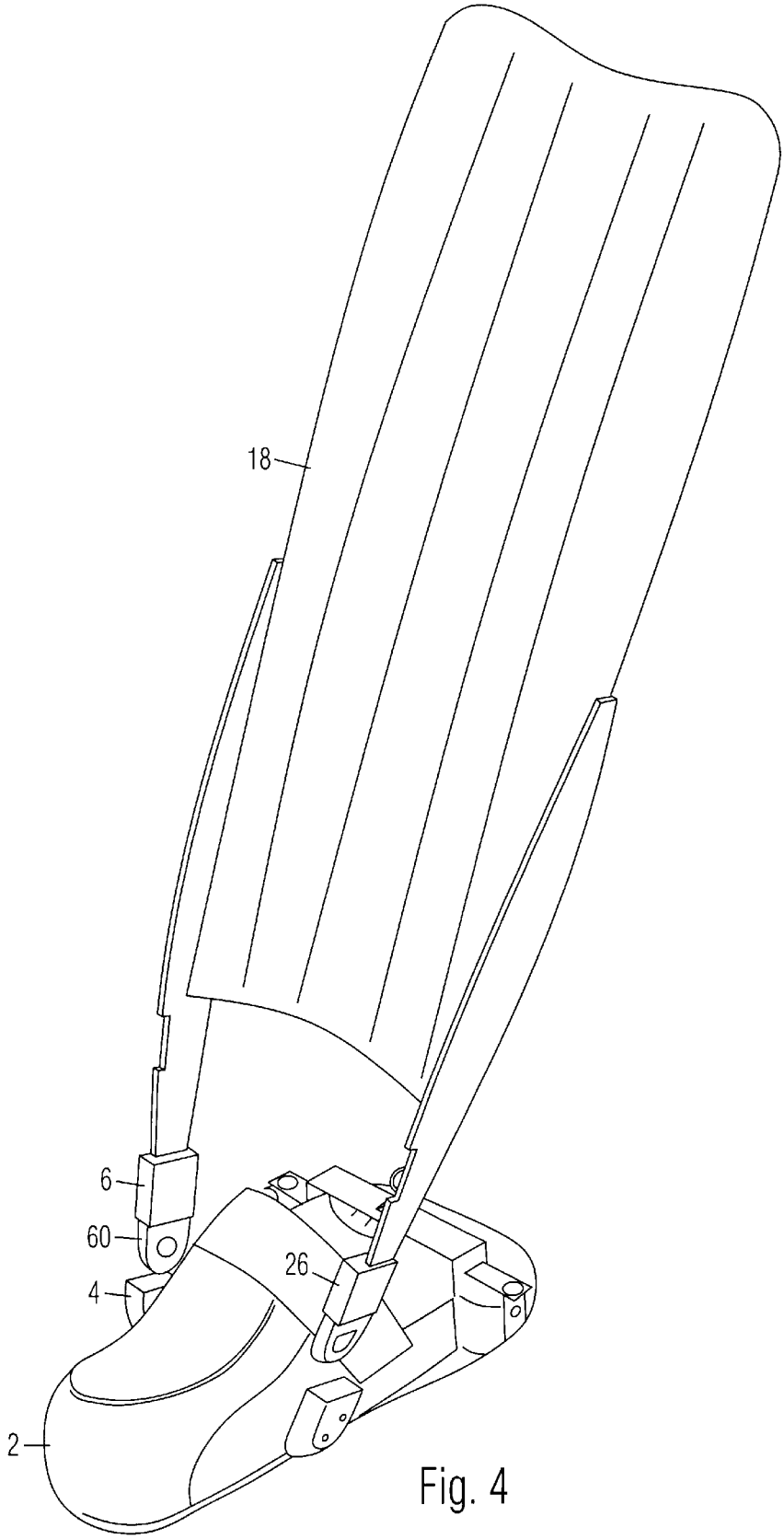
FIG. 4 is a perspective view of the fin as it is removed from the shoe portion
Figure 5:
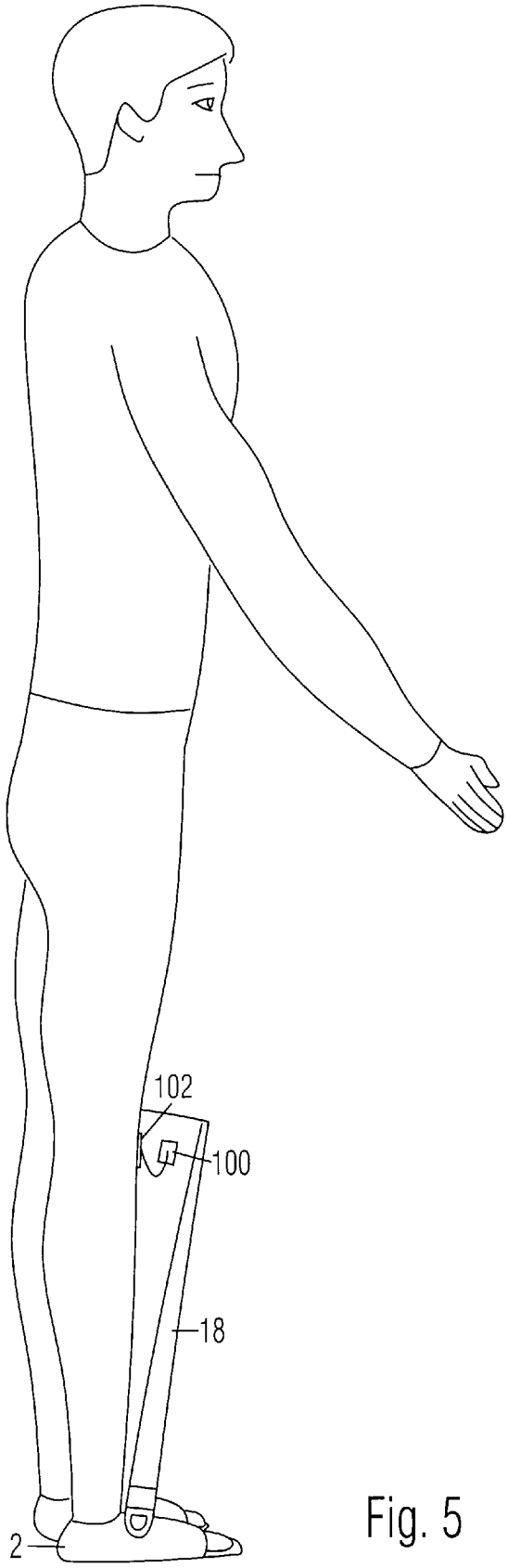
FIG. 5 is a side view of a person wearing the swim fin of the present invention

Referring now to FIG. 1 we see a perspective view of the swim fin of the present invention. Shoe portion 2 is similar to that of other swim fins except that it is separated from fin portion 18. Fin 18 is connected to shoe portion 2 by a pair of rotatable hinges 4, 28. The arms 8, 50 of the fin 18 are attached to the rotatable hinges 4, 28 by a snap fit connector 26, 6 and can be more clearly seen in FIG. 4 where the fin 18 is detached from shoe 2 thereby exposing snap pins 60. Tabs 20, 10 hold fin arms 50, 8 in the down position by providing a restraining force on fin arm portion 24. Rigid inverted U bracket 42 straddles shoe 2 and has slots in it to accept strap 22. Strap 22 is attached at one end to tab 20 and then goes through slot 40 and reappears as it protrudes through slot 44. Strap 22 then proceeds through opposing slot 70 and is attached at its opposite end to tab 10. Pull ring 16 is attached to strap 22 where strap 22 appears in cut out area 44. When a user 14 pulls on pull ring 16 it causes strap 22 to pull inward thereby releasing tabs 20, 10 from arm portions 24, 25 and thereby allowing fin 18 to rotate in an upward manner. Resilient strap 46 is attached each end of the underside of fin arms section 28, 6 so that when tabs 20, 10 are released, the resilient quality of strap 46 causes the fin 18 to pop up several inches thereby making it easier for the user to grab the fin and pull it up. It should be noted that the operating the pull ring 16 is easy and effective even when the user is in the water. It should be also known that all the components of the present invention are stream lined so that no parts protrude to the point where they can cause seaweed and the like to get caught. FIG. 2 shows a more detailed view of shoe 2 and release mechanism 200. Brackets 47, 49 get pulled inward 43, 45 when ring 16 is pulled in an upwards direction. Thereby causing tabs to flex inward and release fin arms 8, 50. FIG. 2 also shows hinge pins 90, 92 as well as rigid sole plate 80. Notice that plate 80 extends beyond the front of shoe 2 by about one inch and acts as a stop for fin 18 when fin 18 is flexed in the downward position. FIG. 3 shows fin 18 rotated to the up position thereby allowing the user to more easily walk on firm surfaces, climb ladders and the like. Velcro patch 100 is affixed to the upper surface of fin 18 and allows for connection to mating velcro patch 110 onto the users wet suit as shown in FIG. 5. If the user is swimming in a warm water environment where a wet suit is not desirable, the user can wear a garter which has a velcro attachment portion on its front facing surface which can mate with velcro 100 on swim fin 18 thereby holding fin 18 in an upright position. FIG. 4 shows how fin 18 can fully detach from shoe 2. Snap clips 60 insert into socket 4 thereby making a firm connection to rotatable hinge 4.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Swim Fin comprising:

a flexible shoe portion;

a pair of rotatable hinge members located on opposite sides of said shoe portion;

a female snap in receptacle located at the end of each said hinge members;

a rigid flat plate located at the sole of said shoe portion, extending beyond the shoe portion by approximately one inch;

a pair of vertically oriented brackets each having outwardly protruding, horizontally placed tabs;

a strap extending from one said tab to the other said tab;

a rigid inverted U shaped member enclosing the forward most portion of said shoe portion and having a central wall and two side walls;

said rigid U shaped member having a slot in each of the side walls and one centrally located slot in the central wall to accept said strap; and a fin having a flat flipper portion and a pair of integral arms extending from said flipper portion that terminate in a male snap that communicates with said female snap located in said hinge member.

2. Swim Fin as claimed in claim 1 wherein said fin portion can be easily removed and replaced with shorter or longer fin portions.

3. Swim Fin as claimed in claim 1 wherein said strap protrudes through said centrally located slot in said inverted U bracket and terminates in a pull ring so that when said pull ring is pulled, said vertically oriented brackets are forced inward thereby causing said horizontal tabs to be removed from the top edge of said fin arms thereby allowing said fin arms and fin to rotate in an upward position to facilitate walking on firm surfaces.

4. Swim Fin as claimed in claim 1 further comprising a flexible band attached at each end to the underside of said fin arms and extending above and around said shoe portion so that when a user pulls said pull ring, said fin automatically pops up a few inches to facilitate said upward rotating action of said fin.

* * * * *